US011953227B2

(12) United States Patent
Zhou

(10) Patent No.: US 11,953,227 B2
(45) Date of Patent: Apr. 9, 2024

(54) FRESH AIR MODULE AND AIR CONDITIONER

(71) Applicant: GD MIDEA AIR-CONDITIONING EQUIPMENT CO., LTD., Guangdong (CN)

(72) Inventor: Yuanle Zhou, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 0 days.

(21) Appl. No.: 17/946,248

(22) Filed: Sep. 16, 2022

(65) Prior Publication Data

US 2023/0016748 A1 Jan. 19, 2023

Related U.S. Application Data

(63) Continuation of application No. PCT/CN2020/129246, filed on Nov. 17, 2020.

(30) Foreign Application Priority Data

Mar. 30, 2020 (CN) ..... 202010241374.8

(51) Int. Cl.
*F24F 13/20* (2006.01)
*F24F 1/0011* (2019.01)
(Continued)

(52) U.S. Cl.
CPC ..... *F24F 13/20* (2013.01); *F24F 1/0011* (2013.01); *F24F 1/0018* (2013.01); *F24F 1/0057* (2019.02); *F24F 8/10* (2021.01)

(58) Field of Classification Search
CPC .. F04D 29/162; F04D 29/4226; F04D 29/703; F05D 2250/51; F05D 2250/52;
(Continued)

(56) References Cited

U.S. PATENT DOCUMENTS 4,245,965 A * 1/1981 Brown ..... F04D 17/04 415/124.2
5,397,950 A * 3/1995 Norbury, Jr. ..... H02K 1/187 310/58
2017/0038087 A1* 2/2017 Nabeshima ..... F24F 11/523

FOREIGN PATENT DOCUMENTS

CN 2264320 Y 10/1997
CN 107525169 A 12/2017
(Continued)

OTHER PUBLICATIONS

International Search Report and Written Opinion dated Jan. 27, 2021 received in International Application No. PCT/CN2020/129246.
(Continued)

*Primary Examiner* — Brian P Wolcott
*Assistant Examiner* — Maxime M Adjagbe
(74) *Attorney, Agent, or Firm* — Scully, Scott, Murphy & Presser, P.C.

(57) ABSTRACT

A fresh air module and an air conditioner are provided. The fresh air module has a housing and a fan assembly. The housing has a fresh air duct inside the housing. The fan assembly has a motor and a wind wheel disposed in the fresh air duct. The motor has a motor body and a motor shaft. The motor shaft drives the wind wheel to rotate, so as to guide airflow to flow through the fresh air duct. The motor cover is arranged on the housing and outside of the fresh air duct. A motor accommodating cavity is defined in the motor cover and accommodates the motor body. A partition member is formed between the motor accommodating cavity and the fresh air duct to separate the motor accommodating cavity from the fresh air duct. The motor shaft penetrates through the partition to connect with the wind wheel.

19 Claims, 6 Drawing Sheets

(51) Int. Cl.
*F24F 1/0018* (2019.01)
*F24F 1/0057* (2019.01)
*F24F 8/10* (2021.01)

(58) Field of Classification Search
CPC ..... F24F 13/20; F24F 1/0057; F24F 1/0018; F24F 8/10
See application file for complete search history.

(56) References Cited

FOREIGN PATENT DOCUMENTS

| | | | | |
|---|---|---|---|---|
| CN | 207299215 | U | 5/2018 | |
| CN | 108571773 | A | 9/2018 | |
| CN | 207881069 | U | 9/2018 | |
| CN | 209181118 | U | 7/2019 | |
| CN | 110657492 | A | 1/2020 | |
| CN | 111306635 | A | 6/2020 | |
| JP | 2016080341 | A | 5/2016 | |
| WO | 1997015790 | A1 | 5/1997 | |
| WO | WO-2009021356 | A1 * | 2/2009 | ..... F04D 25/068 |

OTHER PUBLICATIONS

Supplementary European Search Report dated Aug. 22, 2023 received in European Patent Application No. EP 20928498.3.
Examination Report dated Jul. 21, 2023 received in Australian Patent Application No. AU 2020440785.

* cited by examiner

FRESH AIR MODULE AND AIR CONDITIONER

CROSS-REFERENCE TO RELATED APPLICATIONS

This application is a continuation application of PCT International Patent Application No. PCT/CN2020/129246, filed on Nov. 17, 2020, which claims priority to and benefits of Chinese Patent Application No. 202010241374.8, titled "Fresh Air Module and Air Conditioner" and filed on Mar. 30, 2020. The entire contents of the aforementioned applications are incorporated in this application by reference for all purposes. No new matter has been introduced.

FIELD

The present application relates to the field of air conditioning, and in particular, to a fresh air module and an air conditioner.

BACKGROUND

In the related industry, the air conditioners on the market are usually provided with fresh air modules, and fresh air of the outdoors can be introduced into the indoors by the fresh air modules, to replenish the amount of fresh air of the indoors and improve the air quality of the indoors.

To this end, a wind wheel assembly is usually needed to be configured in the fresh air module to guide the airflow to the indoors from the outdoors. However, the operation of the motor in the wind wheel assembly generates noise, and the noise is amplified by the airflow in the fresh air duct and enters the indoors.

SUMMARY

The main objective of the present application is to provide a fresh air module and an air conditioner including the fresh air module, which aim to reduce the noise generated by the fresh air module.

In order to achieve at least the above objective, the present application provides a fresh air module, which includes:

- a housing provided with a fresh air inlet and a fresh air outlet, a fresh air duct being formed in the housing and communicating with the fresh air inlet and the fresh air outlet;
- a fan assembly including a motor and a wind wheel, where the wind wheel is arranged in the fresh air duct, the motor includes a motor body and a motor shaft, the motor shaft is connected with the wind wheel for driving the wind wheel to rotate and guide airflow to flow into the fresh air duct from the fresh air inlet and flows out through the fresh air outlet; and
- a motor cover disposed on the housing and located outside the fresh air duct, where a motor accommodating cavity is formed in the motor cover, and the motor body is received in the motor accommodating cavity; and
- a partition member disposed between the motor accommodating cavity and the fresh air duct and separating the motor accommodating cavity from the fresh air duct, and the motor shaft passing through the partition member to connect to the wind wheel.

In an embodiment, the motor cover is provided on and extends from an outer wall of the housing to locate the motor accommodating cavity outside of the fresh air duct.

In an embodiment, the fresh air module further includes a purification assembly disposed in the fresh air duct and located between the fresh air inlet and the fresh air outlet, to enable the airflow flows through the purification assembly.

In an embodiment, the purification assembly is located at one side of the wind wheel in an axial direction of the wind wheel to correspond to an air inlet side of the wind wheel.

In an embodiment, the fresh air module further includes a middle partition plate disposed in the fresh air duct and located at the air inlet side of the wind wheel, the middle partition plate is provided with a ventilation opening corresponding to the air inlet side of the wind wheel, and the purification assembly is of a pull-push type, mounted on the middle partition plate and located on an air inlet side of the ventilation opening.

In an embodiment, the housing includes a bottom housing and a cover, the bottom housing is provided with a front side facing a first direction and a rear side facing away from the first direction, the front side of the bottom housing is provided with an opening, the cover covers the front side of the bottom housing, the middle partition plate is arranged between the bottom housing and the cover, an air inlet cavity is formed between the cover and the middle partition plate, and an air outlet cavity is formed between the middle partition plate and the bottom housing, and the wind wheel is arranged in the air outlet cavity.

In an embodiment, the motor cover is provided on and extends from the rear side of the bottom housing, and the motor shaft is started from the motor body and extended into the air outlet cavity along the first direction to connect with the wind wheel.

In an embodiment, the motor cover is integrally formed with the bottom housing, a mounting opening is formed on the bottom housing, the motor accommodating cavity is communicated with the air outlet cavity through the mounting opening, and the partition member covers the mounting opening.

In an embodiment, the bottom housing is provided with a plurality of studs with openings facing the first direction, the plurality of studs are distributed at intervals in a circumferential direction of the mounting opening, a plurality of screws are arranged on the partition member, and each screw is screwed to a corresponding stud to fix the partition member to the bottom housing.

In an embodiment, a plurality of accommodating housings are arranged on a peripheral side of the motor cover, distributed at intervals in a circumferential direction of the motor cover, and integrally formed with the motor cover, an accommodating groove is formed in each accommodating housing and extended in the first direction, and each stud is arranged in a corresponding accommodating groove.

In an embodiment, a plurality of positioning ribs are provided on and extend from the bottom housing and distributed at intervals along a circumferential direction of the mounting opening, a plurality of notches are formed in a peripheral side of the partition member, and each positioning rib is inserted in a corresponding notch.

In an embodiment, a lower side of the motor cover is provided with a wiring port.

In an embodiment, water baffles are provided on and extend from an outer wall of the motor cover, and the water baffles are distributed on a periphery of the wiring port for shielding water flows flowing to the wiring port.

In an embodiment, a wire groove rib is provided on and extends from the rear side of the bottom housing, the wire groove rib and the bottom housing cooperates to form a wire groove extending along a wiring direction for accommodating a wire headed from the wiring port, the wire groove is bent along an extension direction thereof to form a water collecting elbow, and the water collecting elbow is arranged to avoid electronic components.

In an embodiment, a first rubber gasket is arranged between the motor body and the partition member, a second rubber gasket is arranged between the motor body and the motor cover, and the first rubber gasket and the second rubber gasket are distributed at two ends of the motor body in an extension direction of the motor shaft, to limit the motor body in the extension direction of the motor shaft.

In an embodiment, an annular step groove is formed on each of the partition member and the motor cover, and each of the first rubber gasket and the second rubber gasket is accommodated in a corresponding annular step groove to limit the motor body in a radial direction of the motor shaft.

The present application further provides an air conditioner, which includes:

a housing provided with an air inlet, a first air outlet and a second air outlet, where the air inlet is in communication with the first air outlet; and the fresh air module described above, where the fresh air module is mounted in the housing, the fresh air inlet of the fresh air module is adapted to communicate with outdoors through a fresh air tube, and the fresh air outlet of the fresh air module is adapted to communicate with the second air outlet.

In an embodiment, the air conditioner is any one of an indoor unit of a wall-mounted air conditioner, an indoor unit of a cabinet air conditioner, an air machine, an indoor unit of a ceiling type air conditioner or a mobile air conditioner.

In an embodiment, the air conditioner is the indoor unit of the wall-mounted air conditioner, the housing of the air conditioner includes a chassis, a frame and a panel, the fresh air module is mounted at an end of the chassis, the fresh air outlet of the fresh air module faces toward the panel, and the panel is provided with the second air outlet corresponding to the fresh air outlet.

According to the fresh air module of the present application, the motor cover is arranged outside the housing and located outside the fresh air duct. A motor accommodating cavity is formed in the motor cover and accommodates the motor body. A partition member is arranged between the motor accommodating cavity and the fresh air duct to separate the motor accommodating cavity from the fresh air duct. The motor shaft penetrates through the partition member and is connected to the wind wheel for driving the wind wheel. According to the fresh air module provided by the present application, the motor body is arranged outside the fresh air duct and is isolated from the fresh air duct through the partition member, thus the noise amplification effect of the air cavity is avoided, and the noise generated by the fresh air module is reduced.

BRIEF DESCRIPTION OF THE DRAWINGS

In order to more clearly explain the embodiments of the present application or the technical solutions in the related art, the drawings used in the description of the embodiments or the related art will be briefly introduced below. Obviously, the drawings in the following description are merely some embodiments of the present application. For those of ordinary skill in the art, other drawings can be obtained based on the structure shown in these drawings without creative work.

Figure 1:
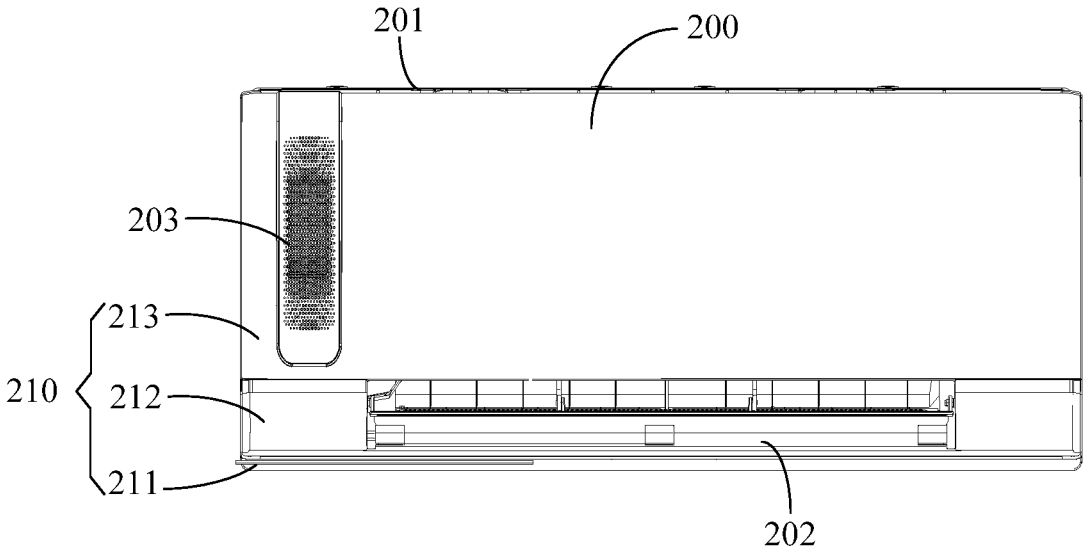
FIG. 1 is a schematic isometric view of an air conditioner according to an embodiment of the present application.

Description of reference signs in the figures is provided in the following table.

| Reference signs | Name | Reference signs | Name | Reference signs | Name |
|---|---|---|---|---|---|
| 10 | Housing | 60 | Wind wheel | 42 | Notch |
| 101 | Fresh air duct | 30 | Motor cover | 51 | First rubber gasket |
| 102 | Fresh air inlet | 31 | Motor shaft | 52 | Second rubber gasket |
| 103 | Fresh air outlet | 32 | Motor body | 200 | Housing |
| 11 | Bottom housing | 304 | Accommo-dating housing | 211 | Chassis |
| 12 | Cover | 301 | Wiring port | 212 | Frame |
| 13 | Middle partition plate | 302 | Water baffle | 213 | Panel |
| 130 | Ventilation opening | 303 | Wire groove rib | 201 | Air inlet |
| 20 | Purification assembly | 3031 | Water collecting elbow | 202 | First air outlet |
| 1011 | Air inlet cavity | 40 | Partition member | 203 | Second air outlet |
| 1012 | Air outlet cavity | 41 | Stud | | |

The realization of the objectives, functional features and advantages of the present application will be further explained with reference to the accompanying drawings in combination with the embodiments.

DETAILED DESCRIPTION OF EMBODIMENTS

It should be noted that all directional indicators (such as up, down, left, right, front, back, etc.) in the embodiments of the present application are only used to explain the relative positional relationship, movement situation, etc. between components in a specific attitude (as shown in the drawings). If the specific attitude changes, the directional indication also changes accordingly.

In addition, the descriptions related to "first", "second" and the like in the present application are for descriptive purposes only, and should not be understood as indicating or implying their relative importance or implicitly indicating the number of technical features indicated. Therefore, a feature defined by "first" and "second" may explicitly or implicitly include at least one of such feature. In addition, the meaning of "and/or" in the full text includes three parallel solutions, taking "A and/or B" as an example, it includes solution A, solution B, or both solutions A and B.

Referring to FIG. 1 to FIG. 9, the present application provides embodiments of a fresh air module and an air conditioner including the fresh air module. The dotted arrow in FIG. 5 indicates an airflow direction. The air conditioner may be an indoor unit of a wall-mounted air conditioner, or an indoor unit of a cabinet air conditioner, or an air machine, or an indoor unit of a ceiling type air conditioner or a mobile air conditioner. In the following embodiments, the indoor unit of the wall-mounted air conditioner is taken as an example for illustration, and provides reference for other types of air conditioner.

Referring to FIG. 1 to FIG. 5, the fresh air module includes a housing 10, a fan assembly and a motor cover 30. The housing 10 is provided with a fresh air inlet 102 and a fresh air outlet 103. The housing 10 is provided with a fresh air duct 101 inside. The fresh air duct 101 communicates with the fresh air inlet 102 and the fresh air outlet 103. The fan assembly includes a motor and a wind wheel 60. The wind wheel 60 is received in the fresh air duct 101. The motor includes a motor body 32 and a motor shaft 31. The motor shaft 31 is connected to the wind wheel 60 to drive the wind wheel 60 to rotate and thereby to drive air to enter the fresh air duct 101 from the fresh air inlet 102 and exit from the fresh air outlet 103. The motor cover 30 is disposed on the housing 10 and located outside the fresh air duct 101. A motor accommodating cavity is formed inside the motor cover 30, and the motor body 32 is disposed in the motor accommodating cavity. A partition member 40 is disposed between the motor accommodating cavity and the fresh air duct 101, to separate the motor accommodating cavity from the fresh air duct 101. The motor shaft 31 passes through the partition member 40 to connect to the wind wheel 60 and drive the wind wheel 60.

Figure 5:
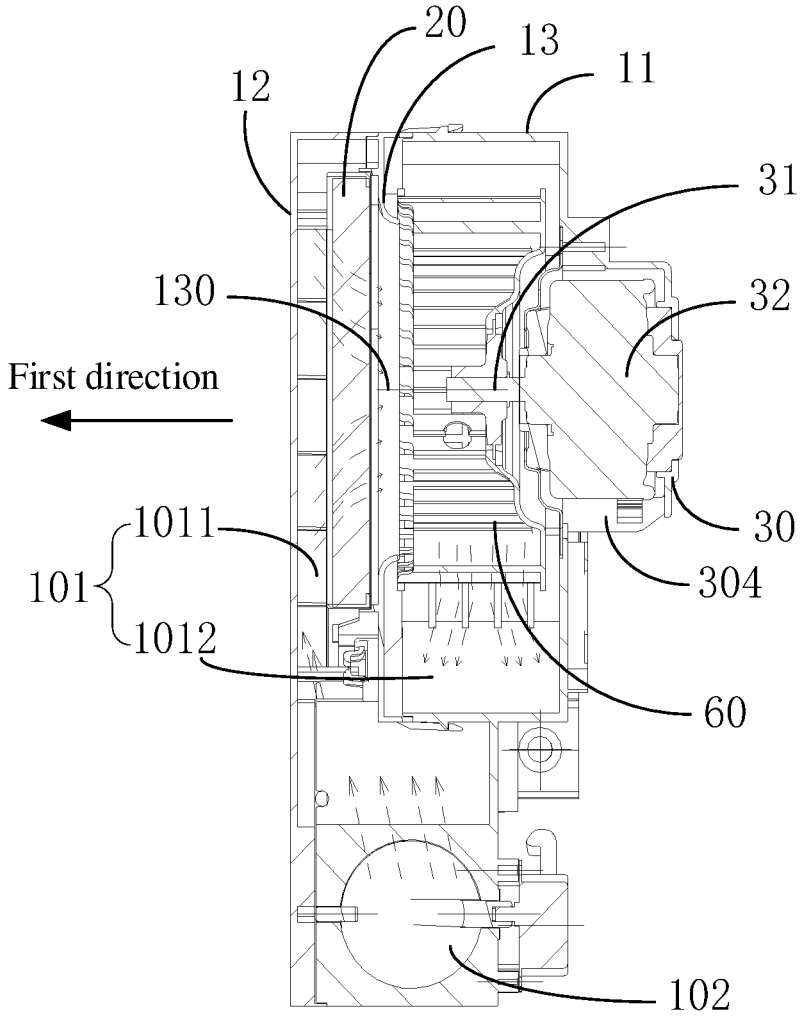
FIG. 5 is a schematic diagram of an airflow direction of the fresh air module of FIG. 2.
Figure 6:
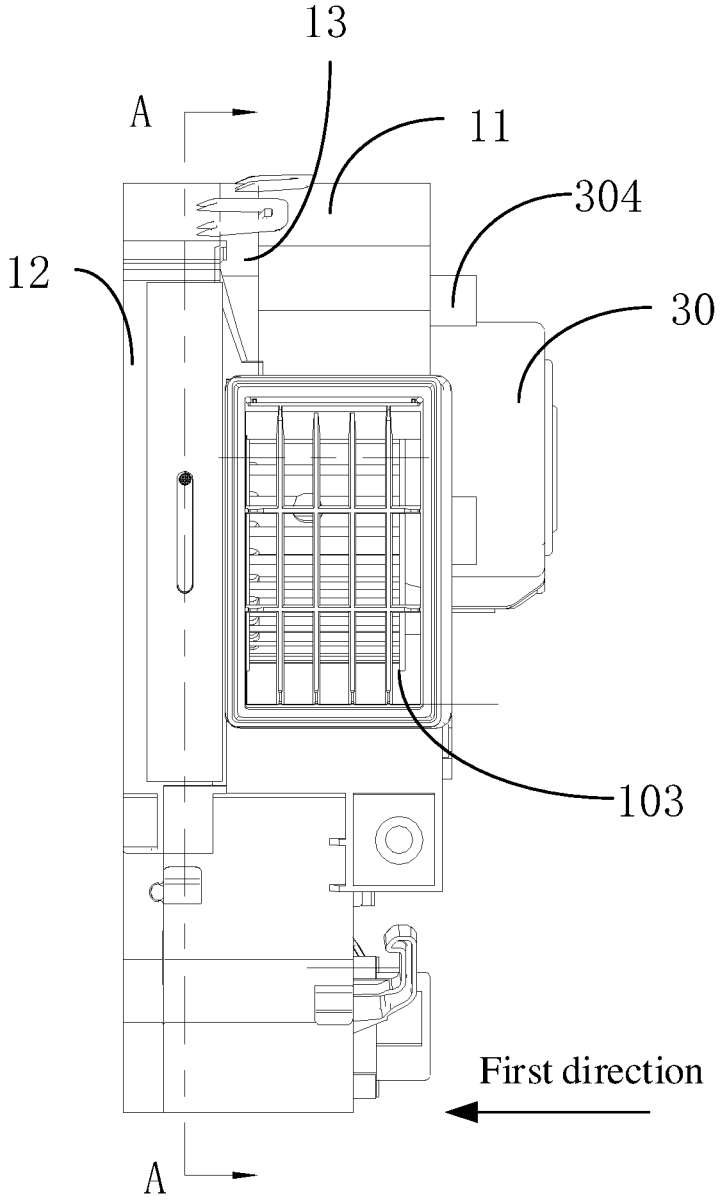
FIG. 6 is a side view of the fresh air module of FIG. 2, showing a side of the fresh air module where a fresh air outlet locates.

In an embodiment, the fresh air inlet 102 may be provided at a bottom of the housing 10 of the fresh air module, and the fresh air outlet 103 may be provided at a top, a front side, a left side or a right side of the fresh air module, and the positions of the fresh air inlet 102 and the fresh air outlet 103 can be designed according to the types of the air conditioners employing the fresh air module in practical applications. In this embodiment, the fresh air inlet 102 can be provided at the bottom of the housing 10, and the fresh air outlet 103 can be provided at a side of the housing 10. The fresh air inlet 102 and the fresh air outlet 103 are distributed in different radial directions of the fan assembly. Referring to FIG. 5, when the fresh air module works, the fan assembly is turned on, and the fan assembly drives fresh air to enter the fresh air duct 101 from the fresh air inlet 102. The fresh air flows to an air inlet side of the wind wheel 60 firstly, and then flows from an air outlet side of the wind wheel 60 to the fresh air outlet 103 and is blown out from the fresh air outlet 103.

The motor includes the motor body 32 and the motor shaft 31. The motor body 32 is provided with a component for driving the motor shaft 31 to rotate. Air noise, mechanical noise, electromagnetic noise and the like are generated during the operation of the motor. For existing air conditioners, the motor is located in the air duct and the air duct diffuses the noises and amplifies the noises. In this embodiment, the motor cover 30 is located outside the fresh air duct 101, and a partition member 40 is provided between the motor accommodating cavity and the fresh air duct 101, thereby the motor accommodating cavity and the fresh air duct 101 are spaced apart from each other. The motor shaft 31 passes through the partition member 40 and is connected to the wind wheel 60 to drive the wind wheel 60. For the motor body 32 is disposed outside the fresh air duct 101 and isolated from the fresh air duct 101 by the partition member 40, the amplification of the noise by the air cavity is avoided, and the noise generated by the fresh air module is reduced.

It should be noted that the motor cover 30 is disposed on the housing 10, and the motor cover 30 may protrude beyond an outer wall of the housing 10, or be disposed in the housing 10, so long as the motor cover 30 is located outside the fresh air duct 101. The motor cover 30 may be disposed separately from the housing 10, or may be integrally formed with the housing 10, or may be configured as a part of the housing 10. It can be understood that when the motor cover 30 is located in the housing 10, the motor is prone to driving the housing 10 to vibrate and generate noise during working, and for the solid transmits sound faster, the noise is amplified. For this purpose, referring to FIG. 5 and FIG. 9, the motor cover 30 is protruded over the outer wall of the housing 10, which makes the motor accommodating cavity located outside of the fresh air duct 101.

The outdoor air usually carries impurities, such as dust and bacteria, which is detrimental to the health of users over time. For this purpose, referring to FIG. 4 and FIG. 5, the fresh air module in the present application further includes a purification assembly 20. The purification assembly 20 is disposed in the fresh air duct 101 and located between the fresh air inlet 102 and the fresh air outlet 103, such that the airflow flows through the purification assembly 20 during the operation of the air conditioner. There are various schemes for the purification assembly 20, and the schemes are not limited herein. For example, the schemes include but are not limited to that the purification assembly 20 includes a mounting frame and a purifying member mounted on the mounting frame. The purifying member may be adapted to remove any one or more types of air pollutant such as dust, fine particulate matter, microorganisms, and organic volatile gases such as formaldehyde in the air. The specific type of the purifying member may be selected according to the function thereof, and the purifying member may be any one or a combination of two or more of a conventional filter screen, a HEPA screen or an IFD filter, or be any one or a combination of one or more of a primary efficiency filter screen, a medium efficiency filter screen, and a high efficiency filter screen. In this way, fresh air flowing into the indoors can be purified, which is good for improving the air quality of the indoors.

Figure 4:
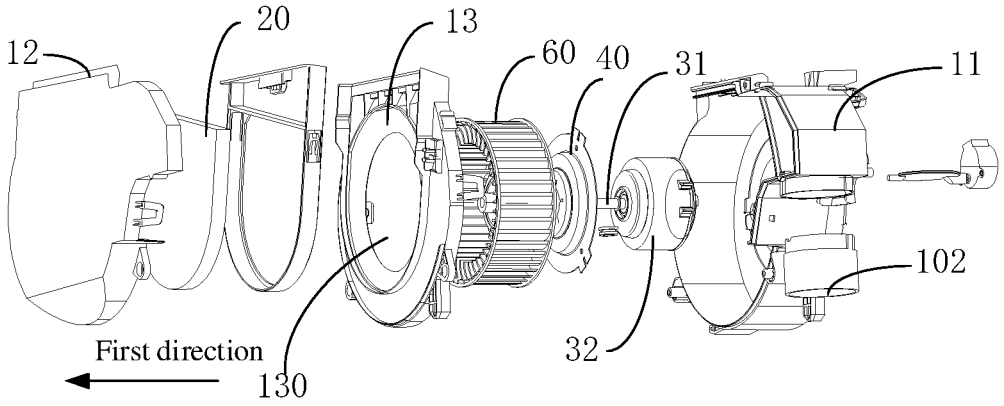
FIG. 4 is an exploded view of the fresh air module of FIG. 2.

In one embodiment, referring to FIG. 4 and FIG. 5, the purification assembly 20 is located at one side of the wind wheel 60 in an axial direction thereof, to correspond to the air inlet side of the wind wheel 60. In this embodiment, the air enters the wind wheel 60 along the axial direction of the wind wheel 60 and exits the wind wheel 60 along an radial direction of the wind wheel 60. As compared to a narrower air inlet surface formed at the fresh air inlet 102 and the vicinity, a larger air inlet surface is formed at the air inlet side of the fan assembly, and thus a relatively large air inlet space is formed at the air inlet side of the fan assembly. Therefore, the purification assembly 20 is arranged to correspond to the air inlet side of the fan assembly, a purification surface of the purification assembly 20, which is provided for the air to pass through and be purified, can be set to be larger, and the efficiency of the purification assembly 20 to purify the air is improved. In addition, since the purification assembly 20 is correspondingly set to be relatively large, the amount of air that can be purified by the purification assembly 20 is correspondingly increased, the service life of the purification assembly 20 is accordingly prolonged and it takes a longer period before a new purification assembly 20 is needed.

Figure 7:
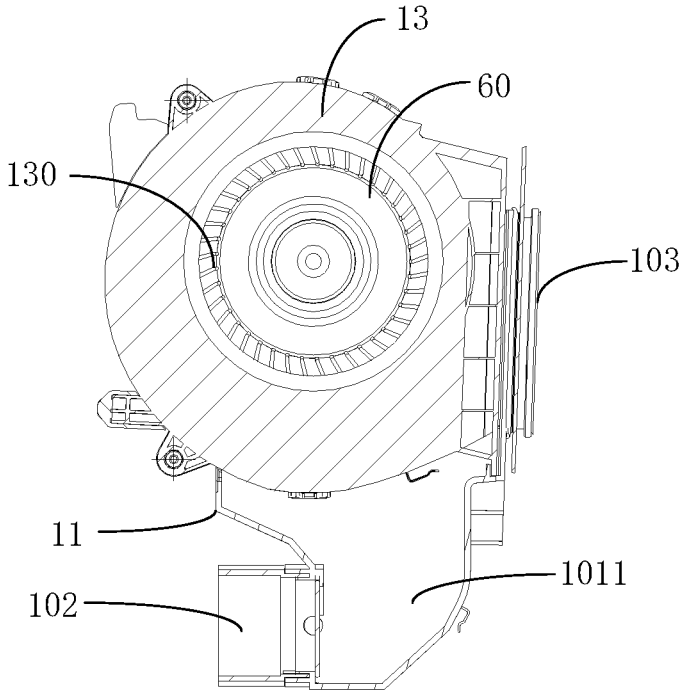
FIG. 7 is a cross-sectional view taken along A-A in FIG. 6.

On the basis of the previous embodiment, referring to FIG. 4, FIG. 5 and FIG. 7, the fresh air module further includes a middle partition plate 13 disposed in the fresh air duct 101 and located at the air inlet side of the wind wheel 60. The middle partition plate 13 is provided with a ventilation opening 130 corresponding to the air inlet side of the wind wheel 60. The purification assembly 20 is of a push-pull type and mounted on the middle partition plate 13, and the purification assembly 20 is located on an air inlet side of the ventilation opening 130. As such, when the purification assembly 20 is in an idle state, the purification assembly 20 may be cleaned or be replaced with a new one. The user can pull the purification assembly 20 by hand, disassemble the purification assembly 20 and replace the purification assembly 20 with a new one, which is simple and easy to operate.

Figure 2:
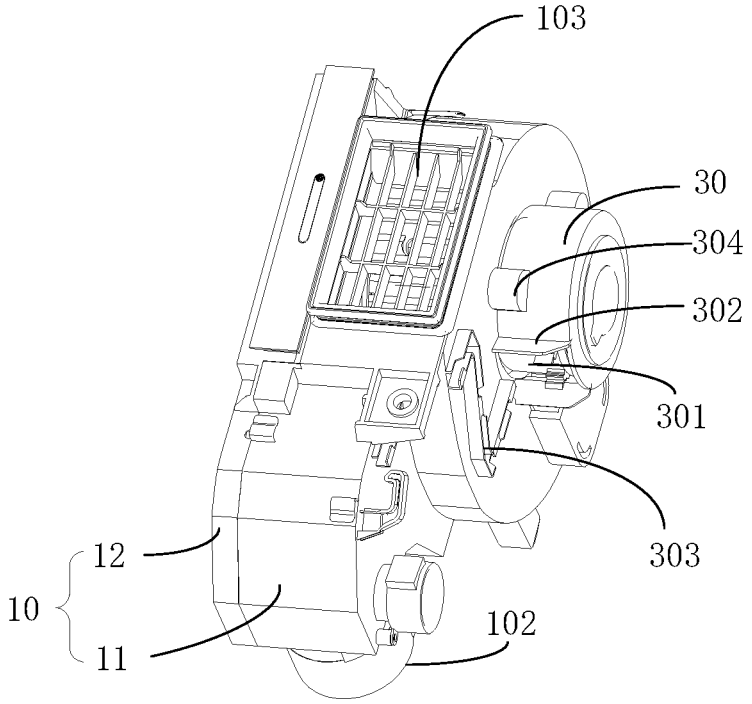
FIG. 2 is a schematic isometric view of a fresh air module according to an embodiment of the present application.

In an embodiment, referring to FIG. 2, FIG. 4 and FIG. 5, the housing 10 includes a bottom housing 11 and a cover 12. The bottom housing 11 has a front side facing a first direction and a rear side facing away from the first direction. The front side of the bottom housing 11 is provided with an opening, and the cover 12 covers the front side of the bottom housing 11. The middle partition plate 13 is disposed between the bottom housing 11 and the cover 12. An air inlet cavity 1011 is formed between the cover 12 and the middle partition plate 13, and an air outlet cavity 1012 is formed between the middle partition plate 13 and the bottom housing 11. The wind wheel 60 is disposed in the air outlet cavity 1012. In this way, since the fresh air duct 101 is divided into the air inlet cavity 1011 and the air outlet cavity 1012 through the middle partition plate 13, the wind wheel 60 is arranged in the air outlet cavity 1012, and the purification assembly 20 prevents impurities such as dust from entering the air outlet cavity 1012, the wind wheel 60 located in the air outlet cavity 1012 is not affected by the impurities, the service life of the wind wheel 60 is prolonged, and the wind wheel 60 can be conveniently cleaned. Furthermore, the arranging of the bottom housing 11 and the cover 12 facilitates the assembling of the fresh air module.

Figure 9:
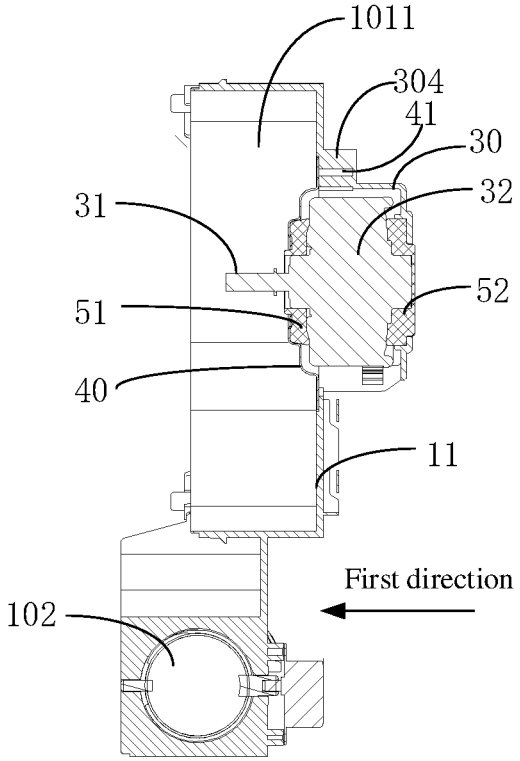
FIG. 9 is a cross-sectional view taken along B-B in FIG. 8.

On the basis of the previous embodiment, referring to FIG. 5 and FIG. 9, the motor cover 30 is arranged on and extends from the rear side of the bottom housing 11, thereby the motor shaft 31 is extended into the air outlet cavity 1012 from the motor body 32 along the first direction, and connected to the wind wheel 60 to drive the wind wheel 60. In this way, both the motor and the wind wheel 60 are located on a side part of the housing 10 where the air outlet cavity 1012 is located, and the installation is facilitated, and an axis of the wind wheel 60 is prevented from passing through the air inlet cavity 1011.

For example, the motor cover 30 can be integrally formed with the bottom housing 11. A mounting opening is formed on the bottom housing 11, and the motor accommodating cavity is communicated with the air outlet cavity 1012 through the mounting opening. The partition member 40 covers the mounting opening. In this way, when to assemble the fresh air module, the operator only needs to install the motor and the wind wheel 60 in the first direction, and does not need to change between the front side and the rear side of the bottom housing 11 in the installation process. Thus the assembling efficiency is improved. Moreover, since the motor cover 30 is integrally formed with the bottom housing 11, there is no relative displacement between the motor cover 30 and the bottom housing 11, and the situation that the motor cover 30 and the bottom housing 11 collide with each other and generate noise under the vibration of the motor is avoided, and thus the noise of the fresh air module during working is further reduced.

There are various ways to fix the partition member 40 to the bottom housing 11. In this embodiment, referring to FIG. 8 and FIG. 9, the bottom housing 11 is provided with a plurality of studs 41 with openings facing the first direction, and the plurality of studs 41 are distributed at intervals along a circumferential direction of the mounting opening. The partition member 40 are provided with a plurality of screws, and the screws are screwed to the studs 41 correspondingly, to fix the partition member 40 to the bottom housing 11. In this way, the partition member 40 is fixed by the cooperation of the screws and the studs 41, and meanwhile the motor body 32 is also fixed in the motor accommodating cavity. Compared with screw holes, an engagement area between the screws and the studs 41 is larger, and the friction force therebetween is larger. On one hand a firm installation is achieved, and on the other hand, shaking is not prone to occurring. Thus the noise generated by the vibration of the motor is reduced. Moreover, the openings of the studs 41 all face the first direction, which facilitates the operation of the operator in the first direction, and improves the installation efficiency.

Figure 3:
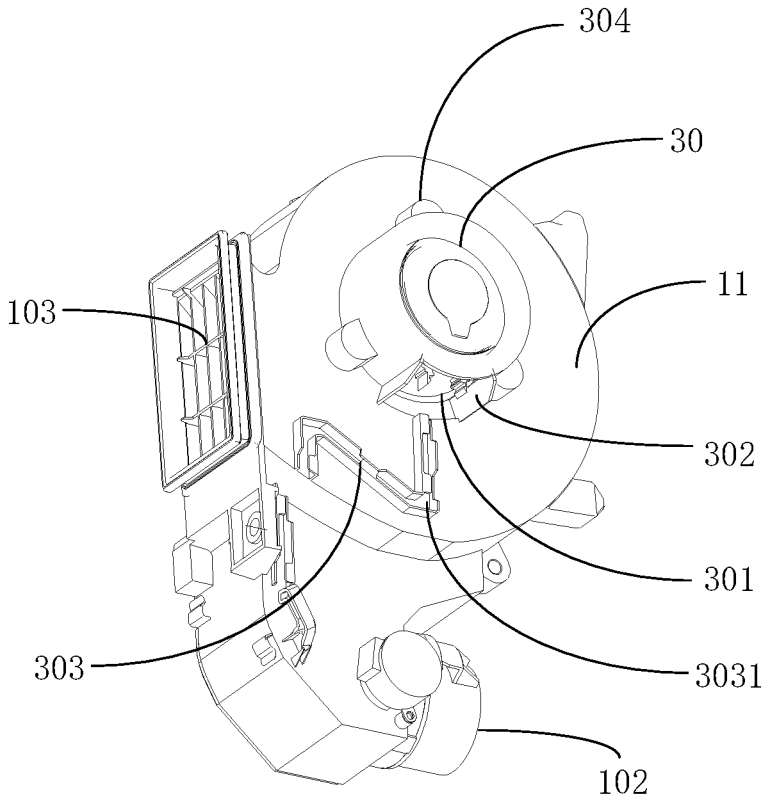
FIG. 3 is a schematic isometric view of the fresh air module of FIG. 2, viewed from another perspective.

On the basis of the previous embodiment, referring to FIG. 3 and FIG. 9, a plurality of accommodating housings 304 are arranged on a peripheral side of the motor cover 30 and distributed at intervals in a circumferential direction of the motor cover 30. The accommodating housings 304 are integrally formed with the motor cover 30. An accommodating groove is formed in each accommodating housing 304 and extended in the first direction, and the studs 41 are arranged in the accommodating grooves. In this way, since the studs 41 are arranged in the accommodating grooves, and the accommodating housings 304 and the motor cover 30 are integrally formed, the studs 41 are structurally stronger. Thus, noise will not be easily generated due to shaking, the structure is compact and the molding is facilitated.

Figure 8:
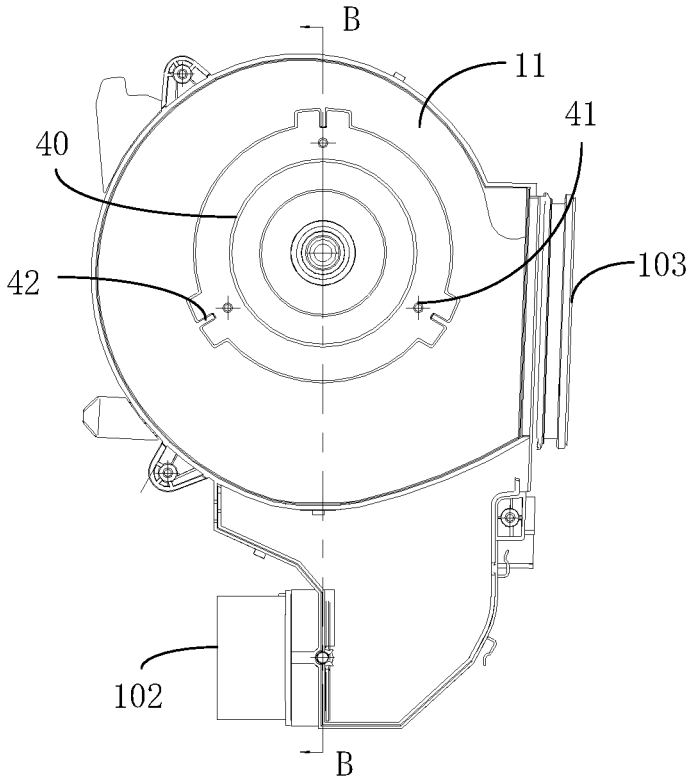
FIG. 8 is a front view of the fresh air module in FIG. 2 with the fresh module facing a first direction and a cover being removed.

On the basis of the foregoing two embodiments, referring to FIG. 8, in this embodiment, a plurality of positioning ribs are arranged on and extend from the bottom housing 11 and distributed at intervals along the circumferential direction of the mounting opening. A plurality of notches 42 are formed in a peripheral side of the partition member 40, and the positioning ribs are inserted into the notches 42 correspondingly. In this way, when to fix the partition member 40, the operator can first sleeve the partition member 40 on the plurality of positioning ribs for pre-locating, and then drives the screws into the studs 41 using a tool to connect and fix the screws with the studs. No additional positioning is needed when to drive the screws, the operation is convenient, and the installation efficiency is high.

In an embodiment, referring to FIG. 1 and FIG. 2, a wiring port 301 is provided at a lower side of the motor cover 30 for a wire, which is connected to the motor body 32, to pass through. The motor needs to be connected with an external electronic device through a power line or a signal line, and thus the wiring port 301 is needed to be formed on the motor cover 30. The fresh air module introduces the air from the outdoors, when the air conditioner is in a refrigeration state, a temperature of the outdoors is high, and a temperature of the indoors is low. Water tends to condense on outer surfaces of the housing 10 and the motor cover 30. When the fresh air module is adjacent to or located in a heat exchange air duct, more water condenses. Water may also condense on surfaces inside the air conditioner. If the condensed water flows into the motor cavity, the motor may be damaged. For this purpose, in this embodiment, the wiring port 301 is located on the lower side of the motor cover 30, to prevent external condensed water from being directly falling into the wiring port 301 and causing the dampening and damage of the motor.

In an embodiment, referring to FIG. 2, water baffles 302 are provided on and extend from an outer wall of the motor cover 30 and the water baffles 302 are distributed on a periphery of the wiring port 301 for shielding water flows flowing to the wiring port 301. In this way, condensed water flowing along the surface of the motor cover 30 is prevented from flowing into the wiring port 301 and resulting in dampening and damage of the motor.

On the basis of the foregoing two embodiments, referring to FIG. 2, in this embodiment, the rear side of the bottom housing 11 is provided with a wire groove rib 303 extending from the rear side. The wire groove rib 303 and the bottom housing 11 cooperate to form a wire groove. The wire groove is extended along a wiring direction and configured for accommodating the wire headed from the wiring port. The wire groove is bent along an extension direction to form a water collecting elbow 3031, and the water collecting elbow 3031 is arranged to avoid electronic components in the air conditioner.

In an embodiment, referring to FIG. 9, a first rubber gasket 51 is arranged between the motor body 32 and the partition member 40, a second rubber gasket 52 is arranged between the motor body 32 and the motor cover 30, and the first rubber gasket 51 and the second rubber gasket 52 are distributed at two ends of the motor body 32 in an extension direction of the motor shaft 31, to limit the motor body 32 in the extension direction of the motor shaft 31. In this embodiment, the motor is fixed in the motor cover 30 through the first rubber gasket 51 and the second rubber gasket 52. Due to certain elasticity possessed by the rubber, the vibration of the motor can be effectively absorbed, and the noise generated by the motor during working is reduced.

On the basis of the previous embodiment, referring to FIG. 9 again, each of the partition member 40 and the motor cover 30 is formed with an annular step groove, and each of the first rubber gasket 51 and the second rubber gasket 52 is accommodated in a corresponding annular step groove, to limit the motor body 32 in the radial direction of the motor shaft 31. As shown in the figures, the motor body 32 is effectively limited in the axial direction and the radial direction of the motor shaft 31, and the installation thereof is more secure. Further, the motor body 32 is prevented from directly contacting with the partition member 40 and the motor cover 30 with higher hardness, the installation gap is smaller, and the noise generated by vibration in the working process is reduced.

Referring to FIG. 1, the present application further provides an air conditioner. The air conditioner includes a housing 200 and a fresh air module mounted in the housing 200. The detailed structure of the fresh air module refers to the above embodiment. Since the air conditioner adopts all the technical solutions of all the above embodiments, the air conditioner at least possesses the beneficial effects brought by the technical solutions of the above embodiments, which will not be repeated here. The air conditioner is any one of an indoor unit of a wall-mounted air conditioner, an indoor unit of a cabinet air conditioner, an air machine, an indoor unit of a ceiling type air conditioner or a mobile air conditioner. The indoor unit of the wall-mounted air conditioner is taken as an example for illustration in the following.

In an embodiment, the housing 200 is provided with an air inlet 201, a first air outlet 202 and a second air outlet 203. The air inlet 201 is in communication with the first air outlet 202. The fresh air module is mounted in the housing 200, the fresh air inlet 102 of the fresh air module is adapted to communicate with the outdoors through a fresh air tube, and the fresh air outlet 103 of the fresh air module is adapted to communicate with the second air outlet 203. Thus, the air conditioner has an indoor air circulation mode and a fresh air mode.

In the indoor air circulation mode, the indoor air enters the housing 200 through the air inlet 201, cold air or hot air is generated after heat exchange by a heat exchange assembly inside the housing 200, and then the cold air or hot air is blown back to the indoors from the first air outlet 202 to realize the indoor air circulation.

In the fresh air mode, the outdoor air enters the fresh air module through the fresh air tube, and clean fresh air is generated after purification by the purification assembly of the fresh air module. The fresh air is blown to the second air outlet 203 of the housing 200 from the fresh air outlet 103 of the fresh air module, and finally blown to the indoors from the second air outlet 203, to replenish the fresh air of the indoors.

In an embodiment, the housing 200 includes a chassis 211, a frame 212 and a panel 213. The fresh air module is mounted at an end of the chassis 211. The fresh air outlet 103 of the fresh air module faces toward the panel 213. Accordingly, the panel 213 is provided with the second air outlet 203 corresponding to the fresh air outlet 103, so that the fresh air is output by the air conditioner and accurately reaches where the user stays.

In addition, in order to prevent the fresh air from being directly blown to the user, the second air outlet 203 may be set to consist of a plurality of micropores penetrating through the panel 213. Therefore, after the fresh air is blown out from the plurality of micropores, the airflow is divided into small airflows with a smaller diameter, the speed of the airflows is reduced, the airflows become soft, and are not directly blown to the user, which avoids causing discomfort to the user.

The above are only exemplary embodiments of the present application, and are not intended to limit the scope of the present application. Any equivalent structural transformation made by using the specification and drawings of the present application, or any direct or indirect application to other related technical fields under the inventive concept of the present application, is included in the claimed scope of the present application.

What is claimed is:

1. A fresh air module comprising:

a housing provided with a fresh air inlet and a fresh air outlet, a fresh air duct being formed in the housing and communicating with the fresh air inlet and the fresh air outlet;

a fan assembly comprising a motor and a wind wheel, wherein the wind wheel is arranged in the fresh air duct, the motor comprises a motor body and a motor shaft, the motor shaft is connected with the wind wheel for driving the wind wheel to rotate and guide airflow to flow into the fresh air duct from the fresh air inlet and flows out through the fresh air outlet;

a purification assembly disposed in the fresh air duct and located between the fresh air inlet and the fresh air outlet, such that the airflow flows through the purification assembly;

a motor cover disposed on the housing and located outside the fresh air duct, wherein a motor accommodating cavity is formed in the motor cover, and the motor body is received in the motor accommodating cavity; and a partition member disposed between the motor accommodating cavity and the fresh air duct and separating the motor accommodating cavity from the fresh air duct, and the motor shaft passing through the partition member to connect to the wind wheel, wherein the purification assembly is located on a first side of the wind wheel on a rotational axis of the wind wheel to correspond to an air inlet side of the wind wheel and the partition member is located on a second side of the wind wheel opposite to the first side of the wind wheel on the rotation axis of the wind wheel.

2. The fresh air module according to claim 1, wherein the motor cover is provided on and extends from an outer wall of the housing to locate the motor accommodating cavity outside of the fresh air duct.

3. The fresh air module according to claim 1, wherein:

the fresh air module further comprises a middle partition plate disposed in the fresh air duct and located at the air inlet side of the wind wheel, the middle partition plate is provided with a ventilation opening corresponding to the air inlet side of the wind wheel, and the purification assembly is of a pull-push type, mounted on the middle partition plate and located on an air inlet side of the ventilation opening.

4. The fresh air module according to claim 3, wherein:

the housing comprises a bottom housing and a cover, the bottom housing is provided with a front side facing a first direction and a rear side facing away from the first direction, the front side of the bottom housing is provided with an opening, the cover covers the front side of the bottom housing, the middle partition plate is arranged between the bottom housing and the cover, an air inlet cavity is formed between the cover and the middle partition plate, and an air outlet cavity is formed between the middle partition plate and the bottom housing, and the wind wheel is arranged in the air outlet cavity.

5. The fresh air module according to claim 4, wherein the motor cover is provided on and extends the rear side of the bottom housing, and the motor shaft is started from the motor body and extended into the air outlet cavity along the first direction to connect with the wind wheel.

6. The fresh air module according to claim 5, wherein a lower side of the motor cover is provided with a wiring port.

7. The fresh air module according to claim 6, wherein:

an outer wall of the motor cover is provided with a plurality of water baffles extending from the outer wall of the motor cover, and the plurality of water baffles are distributed on a periphery of the wiring port for shielding water flows flowing to the wiring port.

8. The fresh air module according to claim 6, wherein:

the rear side of the bottom housing is provided with a wire groove rib extending from the rear side, the wire groove rib and the bottom housing cooperates to form a wire groove extending along a wiring direction for accommodating a wire headed from the wiring port, and the wire groove is bent along an extension direction of the wire groove to form a water collecting elbow, and the water collecting elbow is arranged to avoid electronic components.

9. The fresh air module according to claim 5, wherein the motor cover is integrally formed with the bottom housing, a mounting opening is formed on the bottom housing, the motor accommodating cavity is communicated with the air outlet cavity through the mounting opening, and the partition member covers the mounting opening.

10. The fresh air module according to claim 9, wherein the bottom housing is provided with a plurality of studs with openings facing the first direction, the plurality of studs are distributed at intervals in a circumferential direction of the mounting opening, a plurality of screws are arranged on the partition member, and each screw is screwed to a corresponding stud to fix the partition member to the bottom housing.

11. The fresh air module according to claim 10, wherein a plurality of accommodating housings are arranged on a peripheral side of the motor cover, distributed at intervals in a circumferential direction of the motor cover, and integrally formed with the motor cover, an accommodating groove is formed in each accommodating housing and extended in the first direction, and each stud is arranged in a corresponding accommodating groove.

12. The fresh air module according to claim 10, wherein:

a plurality of positioning ribs are provided on and extend from the bottom housing, and the plurality of positioning ribs are distributed at intervals along a circumferential direction of the mounting opening, and a plurality of notches are formed in a peripheral side of the partition member, and each positioning rib is inserted in a corresponding notch.

13. The fresh air module according to claim 1, wherein:

a first rubber gasket is arranged between the motor body and the partition member, a second rubber gasket is arranged between the motor body and the motor cover, and the first rubber gasket and the second rubber gasket are distributed at two ends of the motor body in an extension direction of the motor shaft, such that the motor body is limited in the extension direction of the motor shaft.

14. The fresh air module according to claim 13, wherein:

an annular step groove is formed on each of the partition member and the motor cover, and each of the first rubber gasket and the second rubber gasket is accommodated in a corresponding annular step groove to limit the motor body in a radial direction of the motor shaft.

15. An air conditioner comprising:

a housing provided with an air inlet, a first air outlet and a second air outlet, wherein the air inlet is in communication with the first air outlet; and the fresh air module according to claim 1, wherein the fresh air module is provided in the housing, the fresh air inlet of the fresh air module is adapted to communicate with outdoor environment through a fresh air tube, and the fresh air outlet of the fresh air module is adapted to communicate with the second air outlet.

16. The air conditioner according to claim 15, wherein the air conditioner comprises at least one of an indoor unit of a wall-mounted air conditioner, an indoor unit of a cabinet air conditioner, an air machine, an indoor unit of a ceiling type air conditioner or a mobile air conditioner.

17. The air conditioner according to claim 16, wherein:

the air conditioner comprises the indoor unit of the wall-mounted air conditioner, the housing of the air conditioner comprises a chassis, a frame and a panel, and the fresh air module is mounted at an end of the chassis, the fresh air outlet of the fresh air module faces toward the panel, and the panel is provided with the second air outlet corresponding to the fresh air outlet.

18. The fresh air module according to claim 1, wherein the purification assembly further comprises a purification surface provided for the air to pass through and be purified, the purification assembly being configured to prevent impurities from entering the air outlet cavity.

19. The air conditioner according to claim 1, wherein the housing is configured such that the air enters the wind wheel along an axial direction of the wind wheel and exits the wind wheel along a radial direction of the wind wheel.

* * * * *